US010390146B2

(12) United States Patent
Kindred

(10) Patent No.: US 10,390,146 B2
(45) Date of Patent: Aug. 20, 2019

(54) PARALLEL POWER SWITCH FOR HEARING AID

(71) Applicant: Starkey Laboratories, Inc., Eden Prairie, MN (US)

(72) Inventor: Jon S. Kindred, Minneapolis, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 51 days.

(21) Appl. No.: 14/618,687

(22) Filed: Feb. 10, 2015

(65) Prior Publication Data

US 2016/0234605 A1 Aug. 11, 2016

(51) Int. Cl.
*H04R 25/00* (2006.01)

(52) U.S. Cl.
CPC ..... *H04R 25/30* (2013.01); *H04R 2225/61* (2013.01)

(58) Field of Classification Search
CPC .... H04R 25/305; H04R 25/602; H04R 25/30; H04R 25/65; H04R 2225/31; H04R 2225/61; H04R 25/558; H04R 25/556
See application file for complete search history.

(56) References Cited

U.S. PATENT DOCUMENTS 4,803,458 A * 2/1989 Trine ..... H04R 25/65 338/172
4,955,729 A 9/1990 Marx
5,473,496 A * 12/1995 Rouy ..... G11C 16/225 361/18
6,704,424 B2 * 3/2004 Killion ..... H04R 25/305 340/636.1
6,931,141 B2 * 8/2005 Moller ..... H04R 25/556 381/314
7,987,977 B2 * 8/2011 Leedom ..... A61B 5/6817 206/213.1

(Continued)

FOREIGN PATENT DOCUMENTS

DE 3716162 C1 3/1988
EP 1206163 A1 5/2002

(Continued)

OTHER PUBLICATIONS

"European Application Serial No. 16155072.8, Extended European Search Report dated May 31, 2016", 8 pgs.

(Continued)

*Primary Examiner* — Fan S Tsang
*Assistant Examiner* — Angelica M McKinney
(74) *Attorney, Agent, or Firm* — Schwegman Lundberg & Woessner, P.A.

(57) ABSTRACT

Described is state switch for a hearing aid that provides an input to the hearing aid's processing circuitry indicating that battery power has been disconnected by a power switch. The state switch and power switch are configured to operate in parallel. The state switch may provide a signal to a GPIO (general purpose input-output) of the processing circuitry indicating that the battery has been disconnected. Immediately after the battery is disconnected, voltage is maintained for a brief period due to the capacitance of the circuitry, which enables the processing circuitry to take certain steps to avoid device misbehaviors.

17 Claims, 3 Drawing Sheets

(56) References Cited

U.S. PATENT DOCUMENTS

| | | | | |
|---|---|---|---|---|
| 8,290,188 | B2 * | 10/2012 | Suurballe | H04R 25/558 381/312 |
| 9,215,534 | B2 * | 12/2015 | Sacha | H04R 25/43 |
| 2004/0240695 | A1 * | 12/2004 | Leedom | A61B 5/6817 381/328 |
| 2006/0022635 | A1 * | 2/2006 | Li | H02J 7/022 320/107 |
| 2010/0260367 | A1 * | 10/2010 | Hasler | H04R 25/30 381/323 |
| 2011/0051967 | A1 * | 3/2011 | Lim | H04R 25/60 381/322 |
| 2014/0161292 | A1 * | 6/2014 | Higgins | H04R 25/65 381/318 |
| 2016/0295334 | A1 * | 10/2016 | Cherigui | G06F 1/24 |
| 2017/0188162 | A1 * | 6/2017 | Flaig | H04R 25/602 |

FOREIGN PATENT DOCUMENTS

| | | | | |
|---|---|---|---|---|
| EP | 1398995 | A2 | 3/2004 | |
| WO | WO 2010108543 | A1 * | 9/2010 | H04R 25/556 |

OTHER PUBLICATIONS

"European Application Serial No. 16155072.8, Communication Pursuant to Article 94(3) EPC dated Nov. 23, 2017", 6 pgs.
"European Application Serial No. 16155072.8, Response filed Apr. 3, 2018 to Communication Pursuant to Article 94(3) EPC dated Nov. 23, 2017", 32 pgs.

* cited by examiner

PARALLEL POWER SWITCH FOR HEARING AID

FIELD OF THE INVENTION

This invention pertains to electronic hearing aids and methods for their construction.

BACKGROUND

Hearing aids are electronic instruments that compensate for hearing losses by amplifying sound. The electronic components of a hearing aid include a microphone for receiving ambient sound, an amplifier for amplifying the microphone signal in a manner that depends upon the frequency and amplitude of the microphone signal, a speaker for converting the amplified microphone signal to sound for the wearer, and a battery for powering the components.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

It is understood that variations in configurations and combinations of components may be employed without departing from the scope of the present subject matter. Hearing assistance devices typically include a housing, a microphone, processing electronics, and a speaker. The examples set forth herein are intended to be demonstrative and not a limiting or exhaustive depiction of variations.

Figure 1:
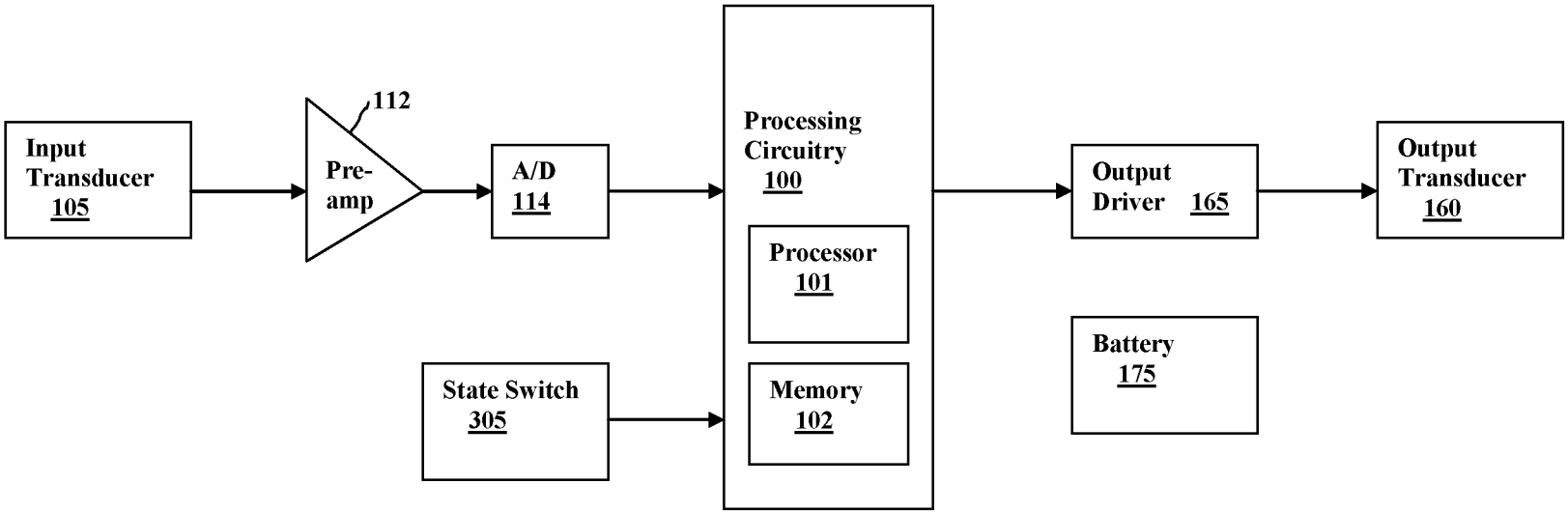
FIG. 1 shows the basic electronic components of an example hearing aid according to one embodiment.

FIG. 1 illustrates the basic functional components of an example hearing aid according to one embodiment. The electronic circuitry of a typical hearing aid is contained within a housing that is commonly either placed in the external ear canal or behind the ear. A microphone or input transducer 105 receives sound waves from the environment and converts the sound into an input signal. After amplification by pre-amplifier 112, the input signal is sampled and digitized by A/D converter 114 to result in a digitized input signal. The device's processing circuitry 100, which includes a processor 101 and a memory 102, processes the digitized input signal in a manner that compensates for the patient's hearing deficit. The output signal is then passed to an output driver 165 that drives an output transducer 160 or receiver for converting the output signal into an audio output. A battery 175 supplies power for the electronic components of the hearing aid.

Also shown in FIG. 1 is a state switch 305 that provides an input to the processing circuitry indicating that the battery power has been disconnected. The state switch may provide a signal to a GPIO (general purpose input-output) or an interrupt line of the processing circuitry indicating that the battery has been disconnected. Immediately after the battery is disconnected, voltage is maintained for a brief period due to the capacitance of the circuitry which enables the processing circuitry to take certain steps to avoid device misbehaviors. When the processing circuitry receives the signal indicating that the battery has been disconnected, it may be configured to cease all activity including writing to memory in order to avoid memory corruption and/or initiate a shutdown sequence.

Figure 2:
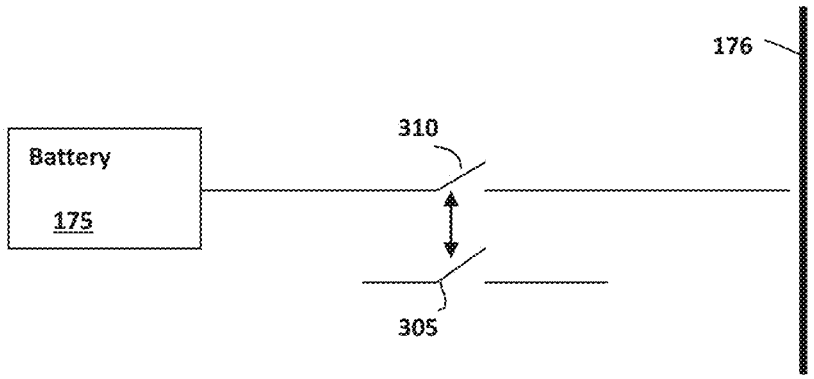
FIG. 2 schematically illustrates a power switch that connects a battery to a power bus.
Figure 3:
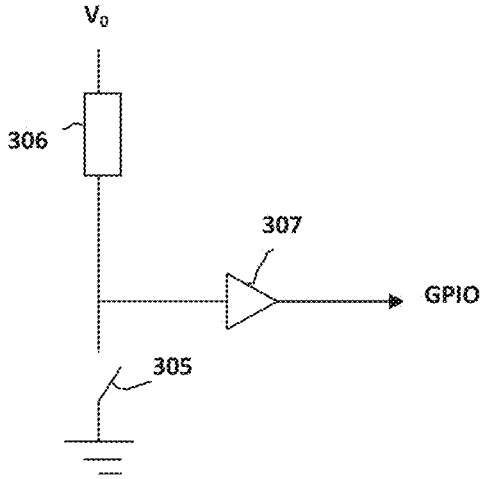
FIG. 3 illustrates an example circuit for a state switch.

FIG. 2 schematically illustrates a power switch 310 that connects the battery 175 to a power bus 176 that supplies power to the hearing aid electronic components. The power switch is coupled to the state switch 305 such that opening of the power switch 310 also opens the state switch 305 to provide the signal to the processing circuitry that the battery has been disconnected. In one embodiment, as shown by FIG. 3, the GPIO for the processing circuitry is either a high or low voltage as provided by buffer amplifier 307. The state switch 305 is configured such that the GPIO is connected to ground when the state switch is closed and connected to a voltage source $V_0$ when the state switch is opened by a pull-up resistor 306. The GPIO going high indicates to the processing circuitry that the battery has been disconnected.

In one embodiment, the state switch 305 and power switch 310 are each formed by a pair of contacts mounted on a battery compartment 255 and battery door 250 such that both switches are opened when the battery door is opened. In certain types of hearing aids, the electronic components are enclosed by a housing that is designed to be worn in the ear for both aesthetic and functional reasons. Such devices may be referred to as in-the-ear (ITE), in-the-canal (ITC), completely-in-the-canal (CIC) type, or invisible-in-the-canal (IIC) hearing aids. Other types of hearing aids, referred to as behind-the-ear (BTE) hearing aids, utilize a housing that is worn behind the ear that contains, among other things, a receiver (i.e., loudspeaker) that conducts sound to an earbud inside the ear via an audio tube. A battery door and battery compartment with integrated power and state switches may be incorporated into any these or other types of hearing aid housings. For example purposes, FIGS. 4 and 5 illustrate such a battery compartment and battery door for an ITC type of hearing aid.

Figure 4:
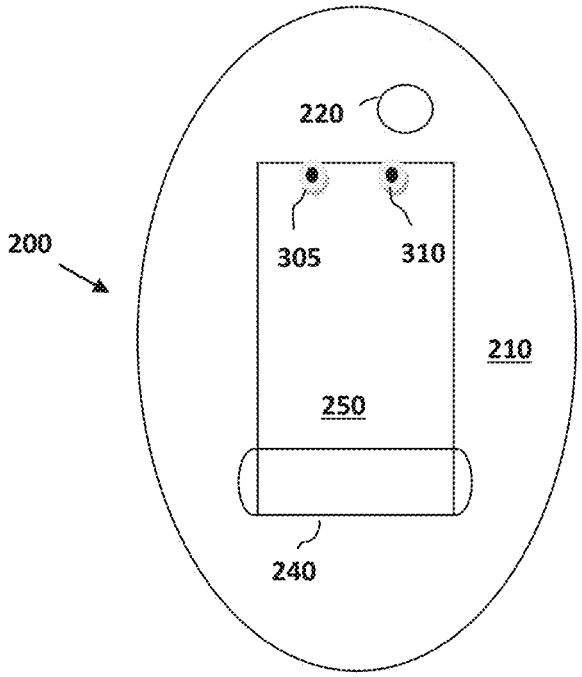
FIGS. 4-5 show the construction of a hearing aid housing with a battery door incorporating a power switch and a state switch.
Figure 5:
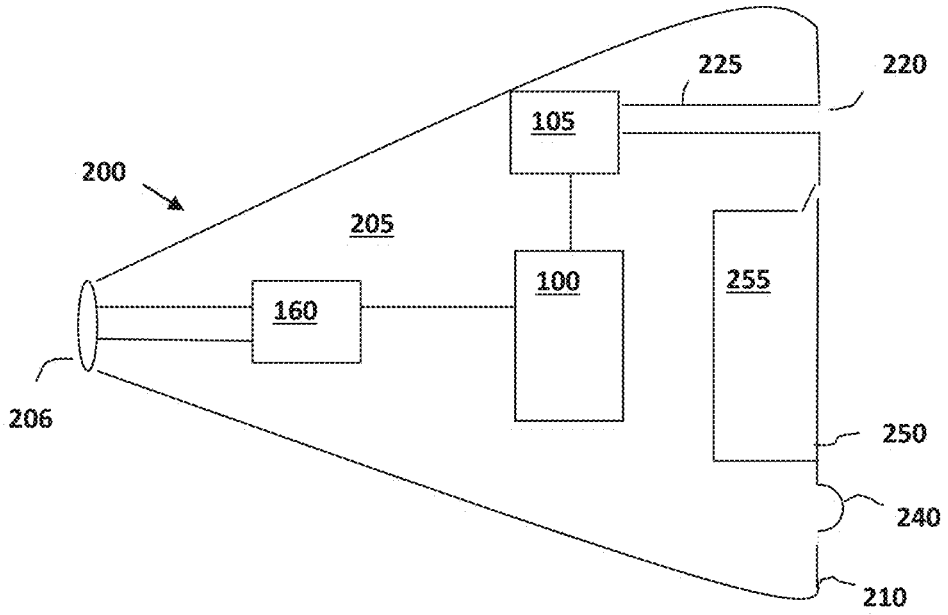

FIGS. 4 and 5 show a top view and a cross-sectional side view, respectively, of an example housing or enclosure 200 for a hearing aid. The cross-section of FIG. 5 is taken vertically through approximately the middle of FIG. 4. The enclosure is made up of an ear mold or shell 205, within which are housed the electronic components described above with reference to FIG. 1, and a faceplate 210. At the end of the ear mold opposite the faceplate is an outlet port 206 for the receiver to convey sound to the wearer's ear. The faceplate includes a sound inlet port 220. As shown in FIG. 3, the sound inlet port 220 opens into a conduit 225 that serves as a microphone inlet pathway to conduct sound to the microphone 105. The signals produced by the microphone are conducted to the processing circuitry 100 which produces an output signal that drives the speaker 160. Sound produced by the speaker 160 is conducted through a conduit 205 to the outlet port 206. Also hingedly mounted on the faceplate via hinge 240 is a battery door 250 that opens into a battery compartment 255 to allow replacement of the battery 175. Shown on the battery door in FIG. 4 are contacts 305 and 310 that correspond to the state switch and power switch, respectively.

Example Embodiments

In one example embodiment, a hearing aid, comprises: a microphone for converting an audio input into an input signal; processing circuitry for processing the input signal to produce an output signal in a manner that compensates for a patient's hearing deficit; a speaker for converting the output signal into an audio output; a battery for supplying power to the hearing aid; a power switch for disconnecting the battery from a power bus that conveys power to the hearing aid; a state switch for providing a signal to the processing circuitry indicating that the battery has been disconnected; and, wherein the power switch and state switch are configured to operate in parallel such that actuation of the power switch actuates the state switch. The state switch may provide a signal to a GPIO (general purpose input-put) of the processing circuitry indicating that the battery has been disconnected. The hearing aid may further comprise: a housing for containing components of the hearing aid; a battery compartment within the housing for containing the battery and having a battery door; and, wherein the battery compartment and battery door are configured such that opening the battery door actuates the power switch and the state switch. The power switch and the state switch may each comprise a pair of contacts mounted on the battery door and the battery compartment wherein each pair of contacts are opened when the battery door is opened. The processing circuitry may be configured to initiate a shutdown sequence when the state switch is actuated. The processing circuitry may be configured to cease writing to memory when the state switch is actuated. The state switch may be configured such that the GPIO is connected to ground when the state switch is closed and connected to a higher voltage when the state switch is opened by a pull-up resistor.

The present subject matter can be used in digital hearing aids. Digital hearing aids include a processor. In digital hearing aids with a processor programmed to provide corrections to hearing impairments, programmable gains are employed to tailor the hearing aid output to a wearer's particular hearing impairment. The processor may be a digital signal processor (DSP), microprocessor, microcontroller, other digital logic, or combinations thereof. The processing of signals referenced in this application can be performed using the processor. Processing may be done in the digital domain, the analog domain, or combinations thereof. Processing may be done using subband processing techniques. Processing may be done with frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, and certain types of filtering and processing. In various embodiments the processor is adapted to perform instructions stored in memory, which may or may not be explicitly shown. Various types of memory may be used, including volatile and nonvolatile forms of memory. In various embodiments, instructions are performed by the processor to perform a number of signal processing tasks. In such embodiments, analog components are in communication with the processor to perform signal tasks, such as microphone reception, or receiver sound embodiments (i.e., in applications where such transducers are used). In various embodiments, different realizations of the block diagrams, circuits, and processes set forth herein may occur without departing from the scope of the present subject matter.

It is understood that variations in configurations and combinations of components may be employed without departing from the scope of the present subject matter. Hearing assistance devices may typically include an enclosure or housing, a microphone, processing electronics, and a speaker or receiver. The examples set forth herein are intended to be demonstrative and not a limiting or exhaustive depiction of variations.

The present subject matter can be used for a variety of hearing assistance devices, including but not limited to hearing aids such as in-the-ear (ITE), in-the-canal (ITC), or completely-in-the-canal (CIC) type hearing aids. It is understood that other hearing assistance devices not expressly stated herein may fall within the scope of the present subject matter.

This application is intended to cover adaptations or variations of the present subject matter. It is to be understood that the above description is intended to be illustrative, and not restrictive. The subject matter has been described in conjunction with the foregoing specific embodiments. It should be appreciated that those embodiments may also be combined in any manner considered to be advantageous. Also, many alternatives, variations, and modifications will be apparent to those of ordinary skill in the art. Other such alternatives, variations, and modifications are intended to fall within the scope of the following appended claims.

What is claimed is:

1. A hearing aid, comprising:

a microphone for converting an audio input into an input signal;

processing circuitry for processing the input signal to produce an output signal in a manner that compensates for a patient's hearing deficit, wherein the processing circuitry includes a processor and memory;

a speaker for converting the output signal into an audio output;

a battery for supplying power to the hearing aid;

a power switch for disconnecting the battery from a power bus that conveys power to the hearing aid;

a state switch for providing a signal to the processing circuitry indicating that the battery has been disconnected from the hearing aid including the processing circuitry;

wherein the processing circuitry is configured to initiate a shutdown sequence when the state switch is actuated, the processing circuitry having a capacitance;

wherein the shutdown sequence is performed by the processing circuitry while a voltage is maintained after disconnection of the battery due to the processing circuitry's capacitance; and, wherein the power switch and state switch are configured to operate in parallel such that actuation of the power switch actuates the state switch.

2. The hearing aid of claim 1 wherein the state switch provides a signal to a GPIO (general purpose input-output) of the processing circuitry indicating that the battery has been disconnected.

3. The hearing aid of claim 2 further comprising:

a housing for containing components of the hearing aid;

a battery compartment within the housing for containing the battery and having a battery door; and, wherein the battery compartment and battery door are configured such that opening the battery door actuates the power switch and the state switch.

4. The hearing aid of claim 3 wherein the power switch and the state switch each comprise a pair of contacts mounted on the battery door and the battery compartment wherein each pair of contacts are opened when the battery door is opened.

5. The hearing aid of claim 4 wherein the processing circuitry is configured to cease writing to memory when the state switch is actuated.

6. The hearing aid of claim 4 wherein the state switch is configured such that the GPIO is connected to ground when the state switch is closed and connected to a higher voltage when the state switch is opened by a pull-up resistor.

7. A method for constructing a hearing aid, comprising:

disposing a microphone, processing circuitry that includes a processor and memory, a speaker, and a battery within a housing;

providing a power switch on the housing for disconnecting the battery fro a a power bus that conveys power to the hearing aid;

providing a state switch on the housing for inputting a signal to the processing circuitry indicating that the battery has been disconnected from the hearing aid including the processing circuitry;

configuring the processing circuitry to initiate a shutdown sequence when the state switch is actuated;

wherein the shutdown sequence is performed by the processing circuitry while a voltage is maintained after disconnection of the battery due to the processing circuitry's capacitance; and, wherein the power switch and state switch are configured to operate in parallel such that actuation of the power switch actuates the state switch.

8. The method of claim 7 further comprising configuring the state switch to provide a signal to a GPIO (general purpose input-output) of the processing circuitry indicating that the battery has been disconnected.

9. The method of claim 8 further comprising:

constructing a battery compartment within the housing for containing the battery and having a battery door; and, constructing the battery compartment and battery door such that opening the battery door actuates the power switch and the state switch.

10. The method of claim 9 wherein the power switch and the state switch each comprise a pair of contacts mounted on the battery door and the battery compartment wherein each pair of contacts are opened when the battery door is opened.

11. The method of claim 9 further comprising configuring the processing circuitry to cease writing to memory when the state switch is actuated.

12. The method of claim 9 further comprising configuring the state switch such that the GPIO is connected to ground when the state switch is closed and connected to a higher voltage when the state switch is opened by a pull-up resistor.

13. A hearing aid, comprising:

means for converting an audio input into an input signal;

processing means for processing the input signal to produce an output signal in a manner that compensates for a patient's hearing deficit, wherein the processing means includes a processor and memory, the processing means including a capacitance;

means for converting the output signal into an audio output;

a battery for supplying power to the hearing aid;

means for disconnecting the battery from a power bus that conveys power to the hearing aid;

means for providing a state signal to the processing means indicating that the battery has been disconnected from the hearing aid including the processing means;

wherein the processing means is configured to initiate a shutdown sequence when the state signal providing means is actuated;

wherein the shutdown sequence is performed by the processing means while a voltage is maintained after disconnection of the battery due to the processing means's capacitance; and, wherein the battery disconnecting means and state signal providing means are configured to operate in parallel.

14. The hearing aid of claim 13 wherein the state signal providing means provides a signal to a GPIO (general purpose input-output) of the processing means indicating that the battery has been disconnected.

15. The hearing aid of claim 14 further comprising:

a housing for containing components of the hearing aid;

a battery compartment within the housing for containing the battery and having a battery door; and, wherein the battery compartment and battery door are configured such that opening the battery door actuates the state signal providing means and the battery disconnecting means.

16. The hearing aid of claim 15 wherein the state signal providing means and the battery disconnecting means each comprise a pair of contacts mounted on the battery door and the battery compartment wherein each pair of contacts are opened when the battery door is opened.

17. The hearing aid of claim 13 wherein the processing means is configured to cease writing to memory when the state signal providing means is actuated.

* * * * *